US011527355B2

(12) United States Patent
Schumm et al.

(10) Patent No.: US 11,527,355 B2
(45) Date of Patent: Dec. 13, 2022

(54) PRIMARY COIL FORMER FOR AN IGNITION COIL, AND IGNITION COIL WITH SUCH A PRIMARY COIL FORMER

(71) Applicant: BorgWarner Ludwigsburg GmbH, Ludwigsburg (DE)

(72) Inventors: Sven Schumm, Walheim (DE); Manfred Adolf, Schwaikheim (DE); Timo Stifel, Freiberg am Neckar (DE); Dirk Wüstenhagen, Auma (DE); Manuel Bauer, Ludwigsburg (DE); Alexander Stark, Althengstett (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 629 days.

(21) Appl. No.: 16/685,250

(22) Filed: Nov. 15, 2019

(65) Prior Publication Data

US 2020/0176180 A1 Jun. 4, 2020

(30) Foreign Application Priority Data

Nov. 30, 2018 (DE) ..... 10 2018 130 504.4

(51) Int. Cl.
*H01F 27/30* (2006.01)
*H01F 38/12* (2006.01)
(Continued)

(52) U.S. Cl.
CPC ..... *H01F 38/12* (2013.01); *H01F 27/245* (2013.01); *H01F 27/2823* (2013.01); *H01F 27/306* (2013.01)

(58) Field of Classification Search
CPC .... H01F 38/12; H01F 27/245; H01F 27/2823; H01F 27/306; H01F 27/2828;
(Continued)

(56) References Cited

U.S. PATENT DOCUMENTS 6,332,458 B1 12/2001 Shimada et al.
6,571,784 B2 6/2003 Shimada et al.
(Continued)

FOREIGN PATENT DOCUMENTS

DE 698 12 350 T2 11/2003
DE 20 2009 001 658 U1 4/2009

*Primary Examiner* — Mang Tin Bik Lian
*Assistant Examiner* — Korey Rashad Walker
(74) *Attorney, Agent, or Firm* — Bose McKinney & Evans LLP

(57) ABSTRACT

A primary coil former for an ignition coil has a winding carrier surface configured for a primary coil wound thereon. Two primary winding stops limit the winding carrier surface at first and second axial ends of the carrier surface, respectively. Two holders are formed at the first axial end, each configured for holding one end of a winding wire. Two deflection domes are formed at the second axial end, one of the domes configured for guiding a winding wire back to the winding carrier surface for a clockwise winding and the other dome configured for guiding a winding wire back to the winding carrier surface for a counterclockwise winding. A groove in the winding carrier surface receives a winding wire which leads from one of the ends of the winding carrier surface up to a gap between the two deflection domes at the opposite end of the winding carrier surface.

6 Claims, 3 Drawing Sheets

(51) Int. Cl.
*H01F 27/245* (2006.01)
*H01F 27/28* (2006.01)

(58) Field of Classification Search
CPC .... H01F 27/325; H01F 2038/122; H01F 5/02; H01F 2005/022; H01F 2005/027; H01F 2005/046; F02P 3/02
See application file for complete search history.

(56) References Cited

U.S. PATENT DOCUMENTS

| | | | | |
|---|---|---|---|---|
| 6,897,755 | B2 * | 5/2005 | Wada | H01F 38/12 336/92 |
| 7,013,883 | B2 | 3/2006 | Shimada et al. | |
| 7,487,767 | B2 * | 2/2009 | Shimada | H01F 27/022 123/634 |
| 2002/0026929 | A1 | 3/2002 | Shimada et al. | |
| 2006/0129890 | A1 | 6/2006 | Shimada et al. | |
| 2008/0136286 | A1 * | 6/2008 | Hiramatsu | H01F 41/082 29/605 |
| 2008/0309445 | A1 * | 12/2008 | Suzuki | H01F 41/069 336/183 |
| 2011/0043315 | A1 * | 2/2011 | Kobayashi | H01F 27/325 29/606 |
| 2017/0200548 | A1 * | 7/2017 | Takagi | H01F 27/2828 |
| 2019/0259523 | A1 * | 8/2019 | Spath | H01F 27/325 |
| 2022/0262561 | A1 * | 8/2022 | Bayliss, III | H01F 27/24 |

* cited by examiner

PRIMARY COIL FORMER FOR AN IGNITION COIL, AND IGNITION COIL WITH SUCH A PRIMARY COIL FORMER

RELATED APPLICATIONS

This application claims priority to DE 10 2018 130 504.4, filed Nov. 30, 2018, the entire disclosure of which is hereby incorporated herein by reference.

BACKGROUND

This disclosure relates to a primary coil former for an ignition coil, and also an ignition coil.

Ignition coils usually contain a primary coil former, on which a primary coil winding is wound. The two ends of the winding wire form the terminal connections of the primary coil. The direction of the magnetic field generated by the primary coil is determined by the winding direction of the primary coil and the current direction, that is to say, by which of the two ends of the winding is connected to potential, and which is connected to ground.

Automotive manufacturers usually specify to their suppliers which winding end is connected to ground and which winding end is connected to potential by means of an assignment of the pins of an electrical connector for the ignition coil. The winding direction of the coil must then be selected such that the desired magnetic field direction ensues with the specified pin assignment. Conventional primary coil formers can only be wound in one direction. A reversed pin assignment therefore requires a different primary coil former.

SUMMARY

This disclosure teaches a primary coil former that can be wound with a primary coil winding in both the clockwise and anticlockwise directions.

According to this disclosure, the primary coil former for an ignition coil has a winding carrier surface configured for winding a primary coil winding onto, two primary winding stops which limit the winding carrier surface in the axial direction, and two holders arranged next to one another, each adapted to hold one end of the winding wire. These holders can be designed as notches or hooks, for example.

The primary coil former comprises two deflection domes at an end of the winding carrier surface facing away from the two holders and also a groove in the winding carrier surface for receiving a winding wire. This groove leads from one end of the winding carrier surface to a gap between the two deflection domes at the opposite end of the winding carrier surface. Depending on the desired winding direction, the winding wire is then led back to the winding carrier surface around one or the other deflection dome and is then wound around the winding carrier surface.

The deflection domes, with their rear faces facing towards the winding carrier surface, can be part of one of the two primary winding stops.

An advantageous refinement of this disclosure comprises a third holder for a winding wire end. By using the central holder and one of the two outer holders, additional freedom can be gained for the spatial arrangement of a connector.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
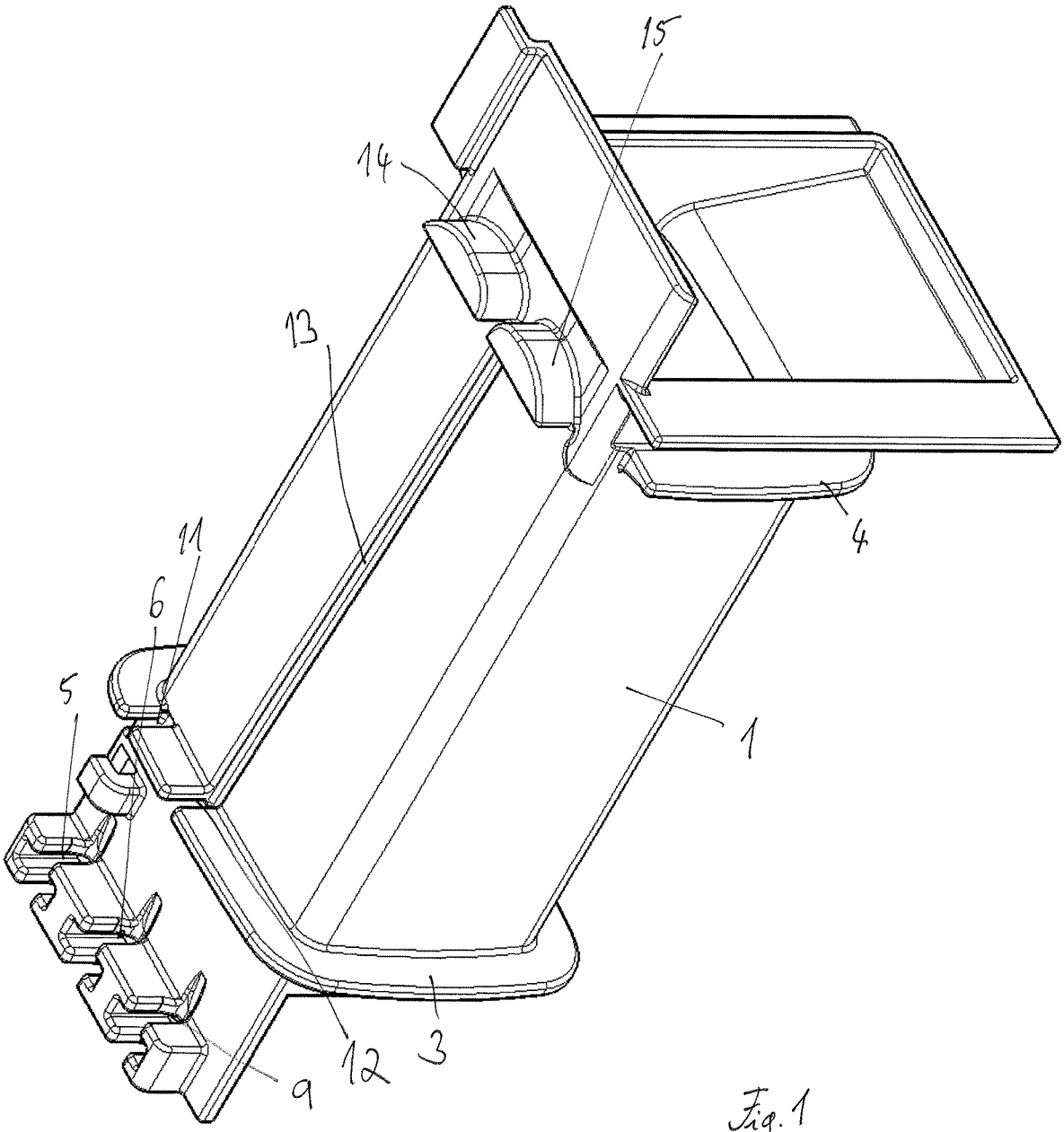
FIG. 1 shows an example of embodiment of an inventive primary coil former.

FIG. 1 shows a primary coil former for an ignition coil. The primary coil former comprises a winding carrier surface 1 for a primary coil winding 2, shown in FIGS. 2 and 3. The winding carrier surface 1 is limited in axial direction at both ends by primary winding stops 3, 4. The primary winding stops 3, 4 can, for example, be designed as a flange or a web. In a completely wound ignition coil, the first winding of the primary coil winding then abuts against one of the stops 4, and the last winding of the primary coil winding against the other stop 3.

The primary coil former also comprises at least two holders 5, 6 arranged next to one another at a first end of the winding carrier surface 1. The holders 5, 6 are configured to each hold one end 7, 8 of the winding wire. The holders 5, 6 can, for example, be designed as notches, hooks or the like. In the example shown, three such holders 5, 6, 9 are arranged next to one another outside the winding carrier surface 1.

The primary winding stop 3 that faces towards the holders 5, 6, 9 has two passages 11, 12 for the ends 7, 8 of the winding wire. From one of these two passages 11, 12, a groove 13 leads through the entire winding carrier surface 1 to the deflection domes 14, 15 at a second end of the winding carrier surface 1. The rear faces of the deflection domes 14, 15, facing towards the winding carrier surface 1, form part of the corresponding primary winding stop 4. The groove 13 ends between the two deflection domes 14, 15. The winding wire is led from one of the holders 6, through the corresponding passage 12 of the primary winding stop 3, in the groove 13 through the gap between the two deflection domes 14, 15, and is then, depending on the desired winding direction, curved around one or the other deflection dome 14, 15, and thus led back to the winding carrier surface 1. The winding wire is then wound around the winding carrier surface 1 until the other end of the winding wire then passes through the second passage 11 of the primary winding stop 3 facing towards the holders 5, 6, 9. This end 7 of the primary winding wire is then fixed in the relevant holder 5 or 9.

Figure 2:
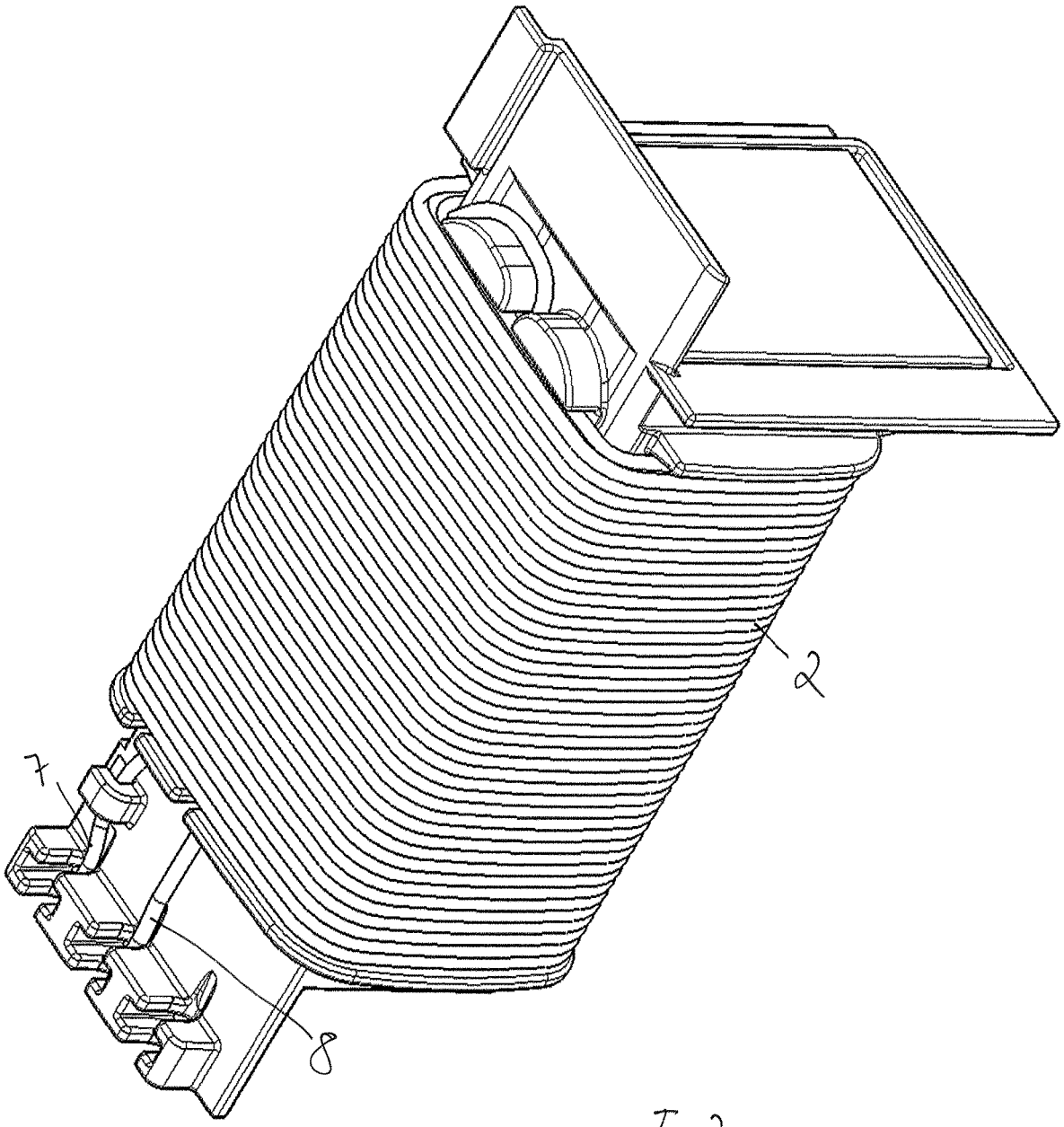
FIG. 2 shows the primary coil former with a primary winding in a first winding direction.
Figure 3:
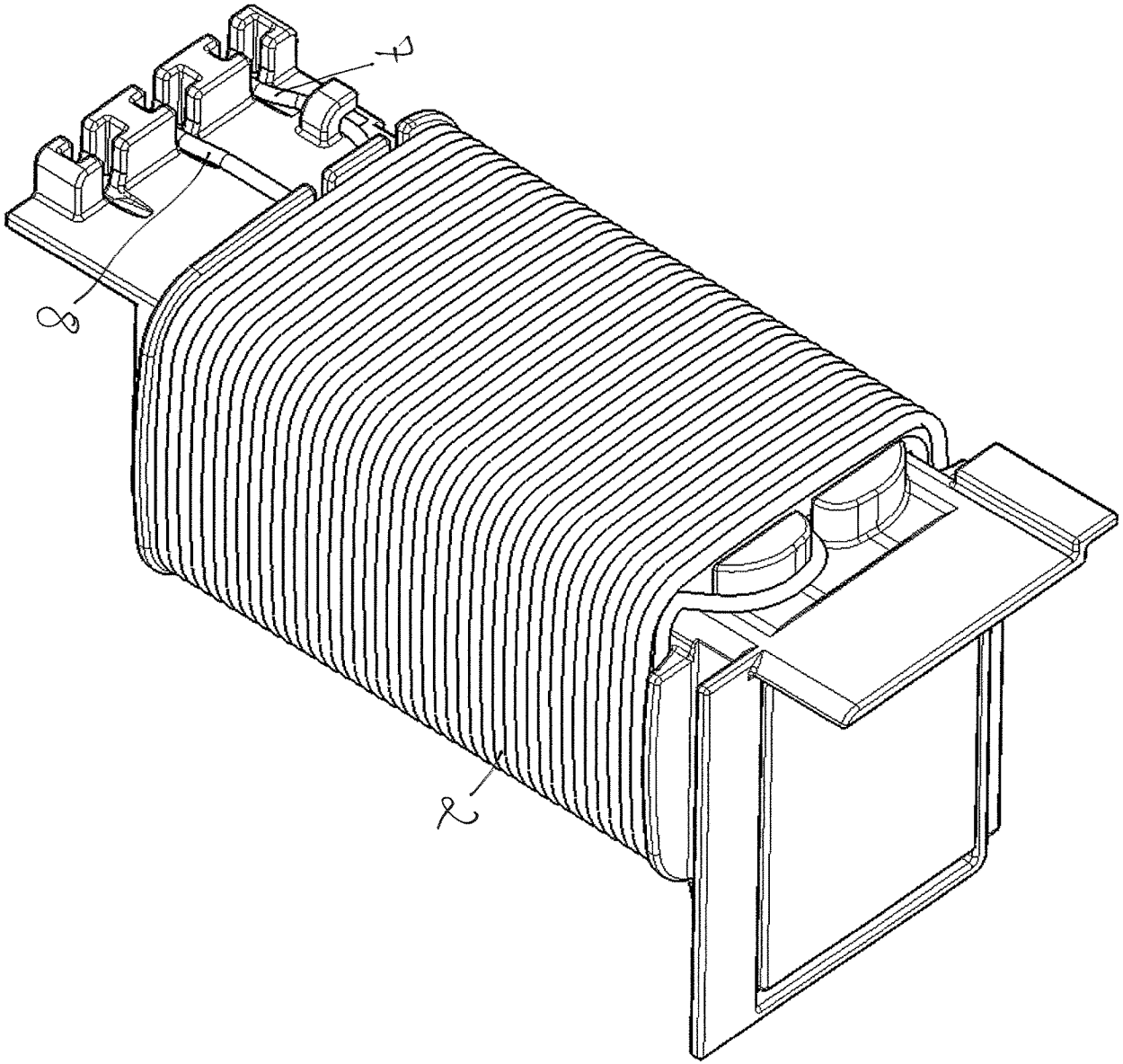
FIG. 3 shows the primary coil former with a primary winding in a second opposing winding direction.

FIG. 2 shows the primary coil former as described, with a primary winding in a first winding direction, while FIG. 3 shows the primary coil former with a primary winding in a second winding direction. As can be seen, the two figures differ essentially in that in one case the winding wire is guided around the left-hand deflection dome 14, and in the other case around the right-hand deflection dome 15.

The primary coil former can be hollow, so to accommodate a core made up, for example, from iron sheets.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Winding carrier surface
2 Primary coil winding
3 Primary winding stop
4 Primary winding stop
5 Holder
6 Holder
7 Winding wire end
8 Winding wire end
9 Holder
11 Passage
12 Passage
13 Groove
14 Deflection dome
15 Deflection dome

What is claimed is:

1. A primary coil former for an ignition coil, comprising:

a winding carrier surface configured to have a primary coil wound thereon;

two primary winding stops limiting the winding carrier surface at first and second axial ends of the carrier surface, respectively;

two holders arranged next to one another at the first axial end of the winding carrier surface, each holder configured for holding one end of a winding wire;

two deflection domes at the second axial end of the carrier surface, one of the domes configured for guiding a winding wire back to the winding carrier surface for a clockwise winding and the other dome configured for guiding a winding wire back to the winding carrier surface for a counterclockwise winding; and a groove in the winding carrier surface, the groove being adapted for receiving a winding wire which leads from one of the ends of the winding carrier surface up to a gap between the two deflection domes at the opposite end of the winding carrier surface.

2. The primary coil former according to claim 1, comprising a third holder configured for a winding wire end, said third holder being arranged next to the two holders.

3. The primary coil former according to claim 1, wherein the primary winding stop, at the first end of the winding carrier surface, comprises a passage for a first end of a primary coil winding and a second passage for a second end of a primary coil winding.

4. The primary coil former according to claim 1, wherein the deflection domes form part of one of the primary winding stops and have rear faces that face towards the winding carrier surface.

5. The primary coil former according to claim 1, wherein the primary coil former is hollow and configured for receiving a core made up of iron sheets.

6. An ignition coil comprising a primary coil former according to claim 1, and having a primary winding wound onto the primary coil former.

* * * * *